US010639538B2

(12) United States Patent
Hooper et al.

(10) Patent No.: US 10,639,538 B2
(45) Date of Patent: May 5, 2020

(54) GOLF PRACTICE DEVICE

(71) Applicant: FIBERBUILT MANUFACTURING INC., Calgary (CA)

(72) Inventors: Michael Hooper, Chestermere (CA); Scott Nichol, Calgary (CA)

(73) Assignee: FIBERBUILT MANUFACTURING INC., Calgary (CA)

( * ) Notice: Subject to any disclaimer, the term of this patent is extended or adjusted under 35 U.S.C. 154(b) by 9 days.

(21) Appl. No.: 15/228,882

(22) Filed: Aug. 4, 2016

(65) Prior Publication Data

US 2017/0036091 A1 Feb. 9, 2017

Related U.S. Application Data

(60) Provisional application No. 62/201,016, filed on Aug. 4, 2015.

(51) Int. Cl.
*A63B 69/36* (2006.01)
*A63B 71/06* (2006.01)

(52) U.S. Cl.
CPC ..... *A63B 69/3661* (2013.01); *A63B 69/3667* (2013.01); *A63B 71/0622* (2013.01); *A63B 2071/0627* (2013.01); *A63B 2071/0633* (2013.01); *A63B 2071/0655* (2013.01)

(58) Field of Classification Search
CPC ..... A63B 69/3661; A63B 69/3667; A63B 71/0622
USPC ..... 473/266–279
See application file for complete search history.

(56) References Cited

U.S. PATENT DOCUMENTS 2,124,123 A * 7/1938 Rosengarten ..... A63B 69/3661 473/278
2,879,996 A 3/1959 Lederer
2,999,431 A * 9/1961 Mitchell ..... E01C 13/045 404/32
4,164,352 A * 8/1979 O'Brien ..... A63B 69/3667 473/218
4,620,998 A 11/1986 Lalvani
4,716,694 A * 1/1988 Freissle ..... E01C 5/20 404/40
4,779,872 A 10/1988 Bisbee
5,002,280 A 3/1991 Hines
5,139,263 A * 8/1992 Feo ..... A63B 69/36 473/218
5,292,130 A 3/1994 Hooper
5,888,147 A 3/1999 Luedtke
6,450,895 B1 9/2002 Galluzzo, Jr.
7,131,910 B2 * 11/2006 Townsend, II ..... A63B 69/3623 473/278
7,824,281 B1 11/2010 Peterson
7,946,935 B2 5/2011 Hooper
8,147,347 B2 4/2012 Hooper
8,298,094 B1 * 10/2012 Chen ..... A63B 69/3644 473/229

(Continued)

*Primary Examiner* — Alvin A Hunter
*Assistant Examiner* — Rayshun K Peng
(74) *Attorney, Agent, or Firm* — Bennett Jones LLP

(57) ABSTRACT

A golf practise mat including a stance section and a ball strike section. The stance section is segmented into a plurality of planar components so that the golf may can be disassembled for shipping and storage. A kit is disclosed including the components and instructions for assembly. A golf practise mat may also have one or more swing training devices for installation of golf training rods.

1 Claim, 8 Drawing Sheets

(56) References Cited

U.S. PATENT DOCUMENTS

| | | | | |
|---|---|---|---|---|
| 8,727,901 | B1 | 5/2014 | Dipatri | |
| 10,052,543 | B1 * | 8/2018 | Steele | A63B 69/3661 |
| 2003/0022725 | A1 * | 1/2003 | Mindlin | A63B 24/0003 473/267 |
| 2006/0240902 | A1 | 10/2006 | Jordan | |
| 2007/0042829 | A1 * | 2/2007 | Dennesen | A63B 69/3661 473/162 |
| 2007/0155526 | A1 * | 7/2007 | McFarlin | A63B 69/3661 473/278 |
| 2007/0293338 | A1 * | 12/2007 | McFarlin | A63B 69/3623 473/278 |
| 2008/0032811 | A1 * | 2/2008 | Bearden | A63B 69/3661 473/278 |
| 2010/0304880 | A1 * | 12/2010 | Li | A63B 69/3661 473/278 |
| 2014/0113737 | A1 | 4/2014 | Zagame et al. | |
| 2014/0335968 | A1 | 11/2014 | Ellington | |
| 2014/0335969 | A1 | 11/2014 | Ellington | |
| 2016/0045805 | A1 | 2/2016 | Hooper | |

* cited by examiner

GOLF PRACTICE DEVICE

FIELD

The present invention relates to a golf practice devices. More specifically, the present invention relates to a golf swing practice devices such as a ground surface swing guide and a golf swing practice mat.

BACKGROUND

Golf practice devices are known. To be successful, the device should be convenient to use and handle. This is particularly true for golf devices intended for personal use.

Golf practice mats are used by golfers to practice their swings. Many forms of practice mats are available. In general a golf practice mat includes a surface within which a ball can be placed. Some mats also are extended to include a place for a golfer to stand. The surface generally is formed to be durable to withstand repeated club strikes and often is formed to simulate a natural ground surface such as short or long grass.

Dimensionally, the mat is usually rectangular in shape, perhaps six feet on the long side, in order to freely accommodate the user while assuming a practice position standing on the mat. As can be expected, the impact of the club head on the simulated grass surface of the mat ultimately results in the wearing or breakdown of the mat in the vicinity of the club head striking zone, which has sometimes necessitated the replacement of the entire golf practice mat, with attendant cost. Also, the golf mat usually comprises a base made of a layer of molded plastic or hard rubber with an overlay of simulated turf attached to the base, which makes the mat bulky and heavy to transport.

SUMMARY

In accordance with a broad aspect of the present invention, there is provided: a golf practice mat comprising: a stance section including a first end and a rear end opposite to the first end; and a strike section releasably connectable at a releasable connection to the first end of the stance section, wherein the stance section includes a base with an underside for placement on a ground surface and an upper surface, the base being segmented into a plurality of stance section components, each of the plurality of stance section components including at least one of (a) a first releasable connection configured to connect to the releasable connection of the strike section and (b) a second releasable connection configured to releasably connect to the second releasable connection of another one of the stance section components.

In accordance with a broad aspect of the present invention, there is provided: a golf practice mat kit comprising: a strike section including a releasable connection at an end; a plurality of releasably connectable stance section components each including at least one of (a) a first releasable connection configured to connect to the releasable connection of the strike section and (b) a second releasable connection configured to releasably connect to the second releasable connection of another one of the stance section components, the strike section and the stance section components being disassembled in the kit; and instructions for assembly of the strike section and the stance section components to obtain a golf practise mat.

In accordance with a broad aspect of the present invention, there is provided: a golf practice mat comprising: a strike section including: a perimeter with a close side, a far side opposite the close side, a front side and a back side, the front side and the back side each spaced apart and spanning between the close side and the far side; a strike surface receiving area positioned centrally within the perimeter; and a first slot formed on at least one of the front side and the back side of the perimeter, the first slot having a length that defines a long axis and the slot extending with its long axis directed from an outer edge of the perimeter toward the strike surface, the first slot configured to accommodate a rod laid along the length.

In accordance with a broad aspect of the present invention, there is provided: a method for swing training using a golf mat, the method comprising: placing the strike section on a ground surface; positioning an end of a rod in the first slot with a length of the rod extending away from the strike section; and swinging a golf club to hit a ball from the strike section while the golf club moves through a path following the length of the rod.

BRIEF DESCRIPTION OF THE DRAWINGS

Referring to the drawings, several aspects of the present invention are illustrated by way of example, and not by way of limitation, in detail in the figures, wherein.

DESCRIPTION OF VARIOUS EMBODIMENTS

The detailed description set forth below in connection with the appended drawings is intended as a description of various embodiments of the present invention and is not intended to represent the only embodiments contemplated by the inventor. The detailed description includes specific details for the purpose of providing a comprehensive understanding of the present invention. However, it will be apparent to those skilled in the art that the present invention may be practiced without these specific details.

The present invention relates to a golf practice device configured to assist a golfer with stance and/or swing alignment. More specifically, the device may be a mat-type structure including swing training structures, alignment markings thereon and/or receptacles for alignment accessories. In one embodiment, the mat-type structure is a golf swing guide structure for placing on the ground and defines therewithin around a ball striking area. In another embodiment, the mat-type structure is a golf swing guide structure with a ball supporting surface defining a ball striking area. In yet another embodiment, the mat-type structure is a golf swing guide mat with a ball supporting surface defining a ball striking area and a stance mat for accommodating a golfer standing thereon. In yet another embodiment, the golf practice mat is configured to facilitate shipping and handling and may be sized and shaped to minimize weight and may employ a modular construction.

Figure 8A:
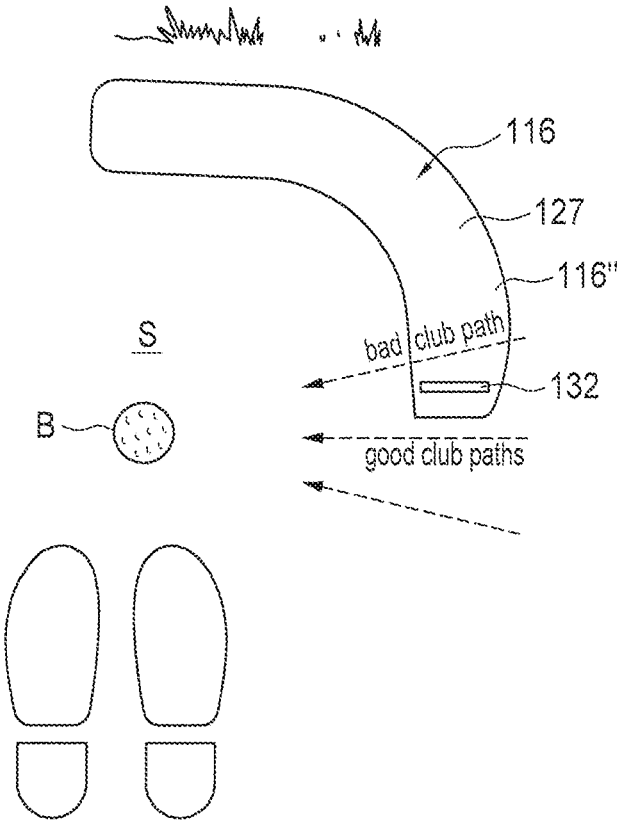
FIG. 8A is a top view of a golf practice device on a ground surface.

Referring to the FIGS. 1 to 7, a golf practice mat 10 is shown. Mat 10 includes a stance section 14 and a strike section 16. In FIGS. 1 to 6C, the stance section and strike section are connected. However, as will be appreciated by explanation hereinbelow, the strike section 16 and stance section 14 could each be employed alone, as individual golf training devices. For example, a golf swing guide 116 is shown in FIG. 8A, which includes only selected portions of the strike section 16.

The mat comprises a base 12. The base is formed of a layer of sheet material, one side of which provides an upper surface 13 for the base. The base may be ½ to 3 inches thick, likely ½ to 1½ inches thick at its thickest point. The base may have underside hollows to reduce material requirements and thereby a reduced cost and weight.

It can be appreciated that stance section 14 or the whole base of the mat may be formed as a single piece of sheet material. However, in the illustrated embodiment shown most clearly in FIG. 7, the golf mat base 13 is configured to be constructed of two or more inter-connectable pieces of material to provide the stance section and the strike section. To facilitate handling, shipping and storage, strike section 16 is releasably connectable at a releasable connection 17*a* to the stance section and the stance section is segmented into separate components, each releasably joinable to the others by further releasable connections 17*b*. The separate components are flat planar pieces for example resembling tiles, having the thickness of base including an underside ground engaging surface and an upper surface which is a portion of upper surface 13 of the base. As such, the entire stance area can be broken down into separate segments, easily transported or stored and then reassembled to form the stance area.

The releasable connections may employ friction fit, overlapping joints, snaps or fasteners, but are configured to resisting shear and expansion forces that will be applied to the components during use. The forces tend to pull the components apart laterally along a direction in plane with the plane defined by upper surface 13. In one embodiment, one side of the releasable connection 17*a*, 17*b* is a substantially orthogonally (relative to upper surface 13) extending receptacle and the other side of the releasable connection is a substantially orthogonally extending protrusion that is pushed or possibly friction fit, as by snapping, into the receptacle. In use, the protrusion and receptacle become oriented generally vertically, thereby opposite to the lateral forces tending to pull the base components apart. One part, the receptacle or the protrusion, may be on a flap extension that extends from a lower edge of the base section component at the releasable connection and the other part may be on an extension that extends from an upper edge of the base section component at the releasable connection, such that the parts can be overlapped and secured together by pushing the protrusion into the receptacle.

To be readily stored and transported, the stance section can be formed into components with maximum dimensions about the same size as the strike section. For example, the stance section can be segmented into two, four or six components with seams 17*c* extending along the length and/or width W and releasably connectable connections 17*b* between each adjacent component.

To facilitate assembly, releasable connections 17*a*, 17*b* can be unique for each adjacent pair of components so that it is evident how the components are to be connected together and in fact it may be difficult to make incorrect connections. For example, the length, shape or size of the connectable parts may be similar but may be different from the parts of other releasable connections on the mat. For example, with reference to FIGS. 3 and 7, it can be observed that the connections 17*a* are sized differently than any connections 17*b*. Further, the connection 17*a* on one side of end 16' is a receptacle and the reverse of the second connection 17*a* on the other side of end 16', which is a protrusion.

In one embodiment, stance section 14 includes a stance area 20 on upper surface 13. Whatever materials the stance section is made of and however the stance section is constructed, the stance section is configured to support the weight of a golfer and to provide a firm surface on which the golfer positions himself while driving. In one embodiment, to facilitate manufacture, the stance area may be formed substantially entirely of one material such as of rubber or plastic. The upper surface of the stance area may be textured to enhance frictional engagement with the soles of the golfer's shoes.

The stance area 20 is sized to accommodate the golfer in a golf stance thereon. Some useful sizes for stance area 20 may be those sized to accommodate a golfer in a golf stance such as a 3 foot wide polygon. In the illustrated embodiment, the shape of the stance area is trapezoid-like, with a mat width W that tapers toward the end adjacent strike section 16. This tapering towards the strike section serves a number of purposes. First, the tapering forces the golfer into a narrower stance as the golfer approaches the strike section. As such, when using shorter clubs and the golfer is closer to the strike section, the mat has less width available for standing and forces the golfer to assume a narrower stance. Second, the tapered shape removes unnecessary mat material adjacent to the strike section, on which a golfer tends never to stand when using the mat.

Similarly the rear end of the mat, which is the end spaced from the strike section 26, may have a concavely-shaped edge, where the edge is curved inwardly between the rear end corners. As with the tapered shape, the concave shaping avoids the need for unnecessary mat material between the rear corners, which is an area on which a golfer tends never to stand when using the mat.

This removal of unnecessary mat material reduces the volume and weight of the mat, which facilitates packaging and handling and reduces costs of material and shipping. Of course, the stance area may be of other shapes, including for example a circle, an oval (ellipse), a polygon other than a trapezoid such as a rectangle, etc.

In the illustrated embodiment, the upper surface of the stance area includes a plurality of spaced-apart alignment markings 24, 30*a*, and 30*b*. The markings are shown in the FIGs. as grooves. Alternatively, the markings 24, 30*a*, 30*b* may be ridges, inserts or applied colourings such as paint. Markings may be formed by moulding or attaching a ridge structure such as by inserting an elongate member such as a flexible or shaped tubular, cable or rod into the groove. In one embodiment, the markings are grooves formed to retain, as by gravity or a frictional fit, a separate elongate member. The separate elongate member may be a stance alignment rod. A stance alignment rod is a commonly available golf accessory and is a substantially straight, elongate structural member having some rigidity. Stance alignment rods come in various colours, and a user may wish to use a rod that has a colour different than the mat surface.

The alignment markings may include one or more arcs 24 extending from side to side across the width W, each representing a projection of a golf swing arc. Each arc is spaced from other arcs and has a curvature that defines the path through which a golfer's hands should pass during a golf swing, as that path would appear when projected on the mat. The arc shaped alignment markings may be used by a golfer using the mat. In particular, when on the mat, the golfer can then look down during a swing and determine if their hands follow the curvature projected on the mat and thereby determine if their swing plane properly follows that curvature of the markings on the upper surface of the stance area 20. Each curved alignment marking 24 has a degree of curvature that depends on the marking's distance from the strike section 16. In a sample embodiment, the curvature of the marking 24 increases the further away the marking is from the strike section. The difference in curvature of the markings is to accommodate for the swings of golf clubs of various lengths. The differences in curvature of alignment markings 24 with distance from strike section illustrate the different swing paths that a golfer should follow when using different golf clubs.

Some other markings 30*a*, 30*b* on upper surface of the stance section may indicate proper stance alignment. The markings may include one or more length-wise lines such as a center length-wise straight line 30*a* and one or more width-wise lines 30*b*. On the upper surface of the stance area, center length-wise line 30*a* may intersect, for example substantially orthogonally, the one or more width-wise lines 30*b* to reference a proper alignment of the golfer's body relative to the strike section 16. These lines may be formed as above, or alternately or in addition by selective positioning of the interconnecting edges 17*d* of the mat's separable components. For example, lines 30*a*, 30*b* may in fact be seams 17*c* that inherently form between adjacent edges on the mat surface at a joint where two inter-connectable components forming the stance or strike sections come together. The top corners of the edges of the two interconnectable components can be chamfered to form a groove at the crack to accommodate an elongate member placed therein.

In a further embodiment, the stance section may have a plurality of spaced-apart holes 34 in its upper surface on one or both of its lengthwise sides. Each hole 34 is configured to removably receive an end of a stance alignment rod 28. The hole 34 may have a small diameter with a substantially cylindrical opening on the surface 13. The center axis of the cylinder can be substantially orthogonal to the upper surface such that a stance alignment rod can be inserted into the hole and held by the hole in a substantially vertical position. As noted, a stance alignment rod 28 is preferably a substantially linear structural member having some rigidity. Preferably, each hole 34 is sized to secure an end of alignment rod 28 inserted therein by pushing. When one end of rod 28 is received in hole 34, the rod is secured to extend substantially orthogonal to the upper surface of the stance section, which is likely to orient the rod substantially vertically during use of the mat, as shown in FIGS. 4 and 5.

Figure 1:
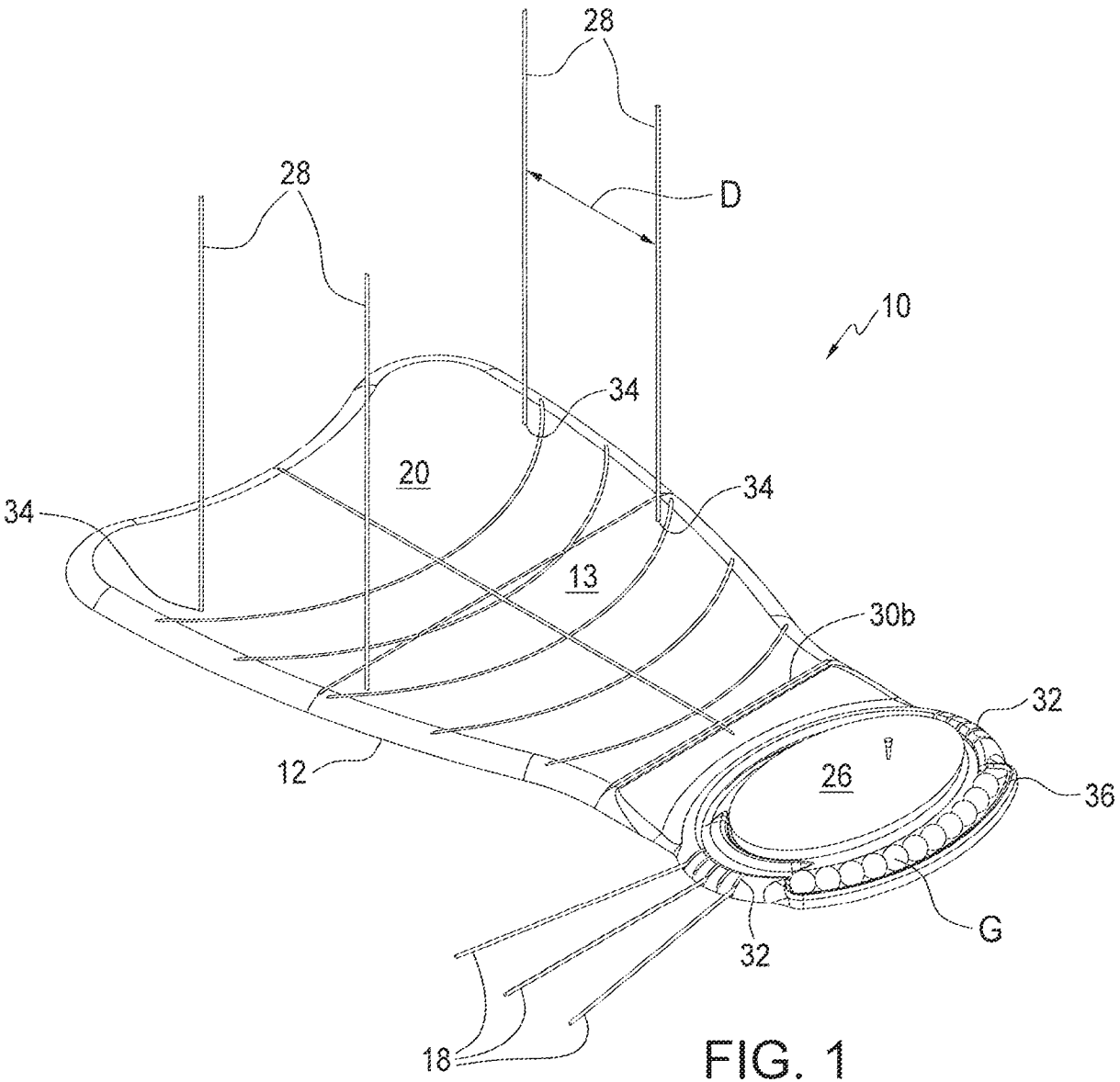
FIG. 1 is a perspective view of a golf practice mat having a plurality of accessories attached thereto, according to one aspect of the present invention.
Figure 4:
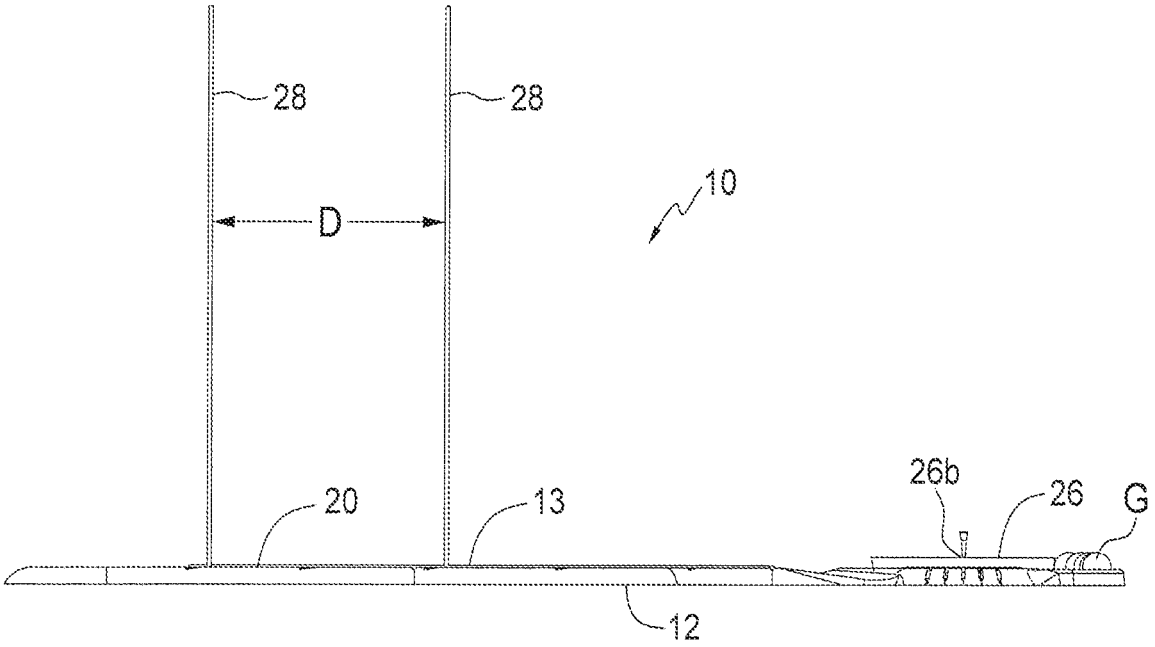
FIG. 4 is a side view of another golf practice mat similar to that of FIG. 1, but without the raised lip adjacent the strike surface.
Figure 5:
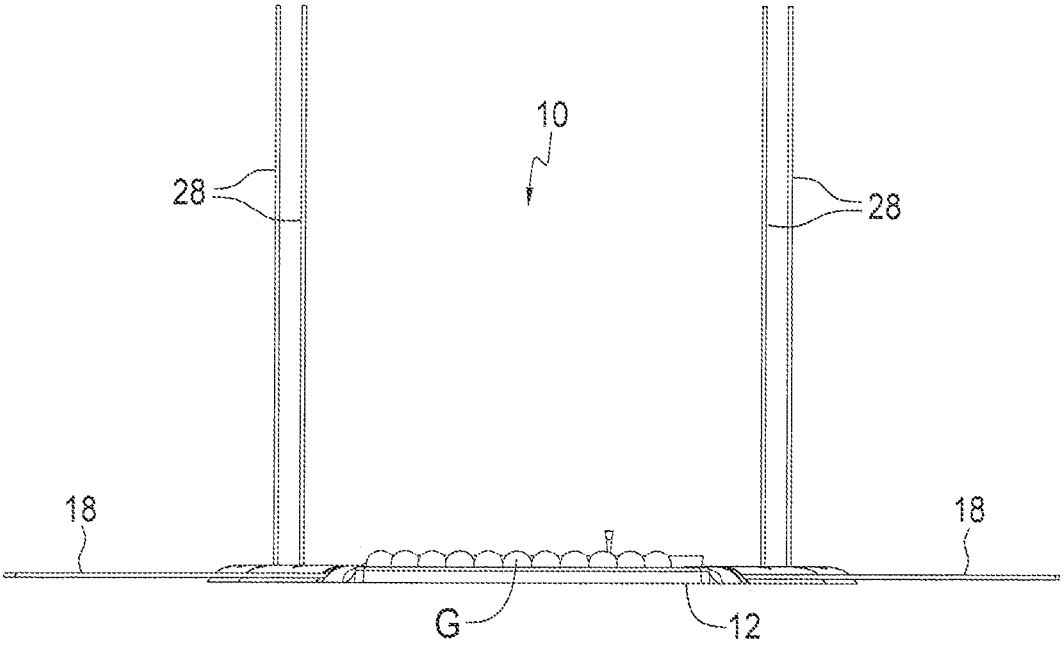
FIG. 5 is a front end view of the golf practice mat of FIG. 4.
Figure 6A:
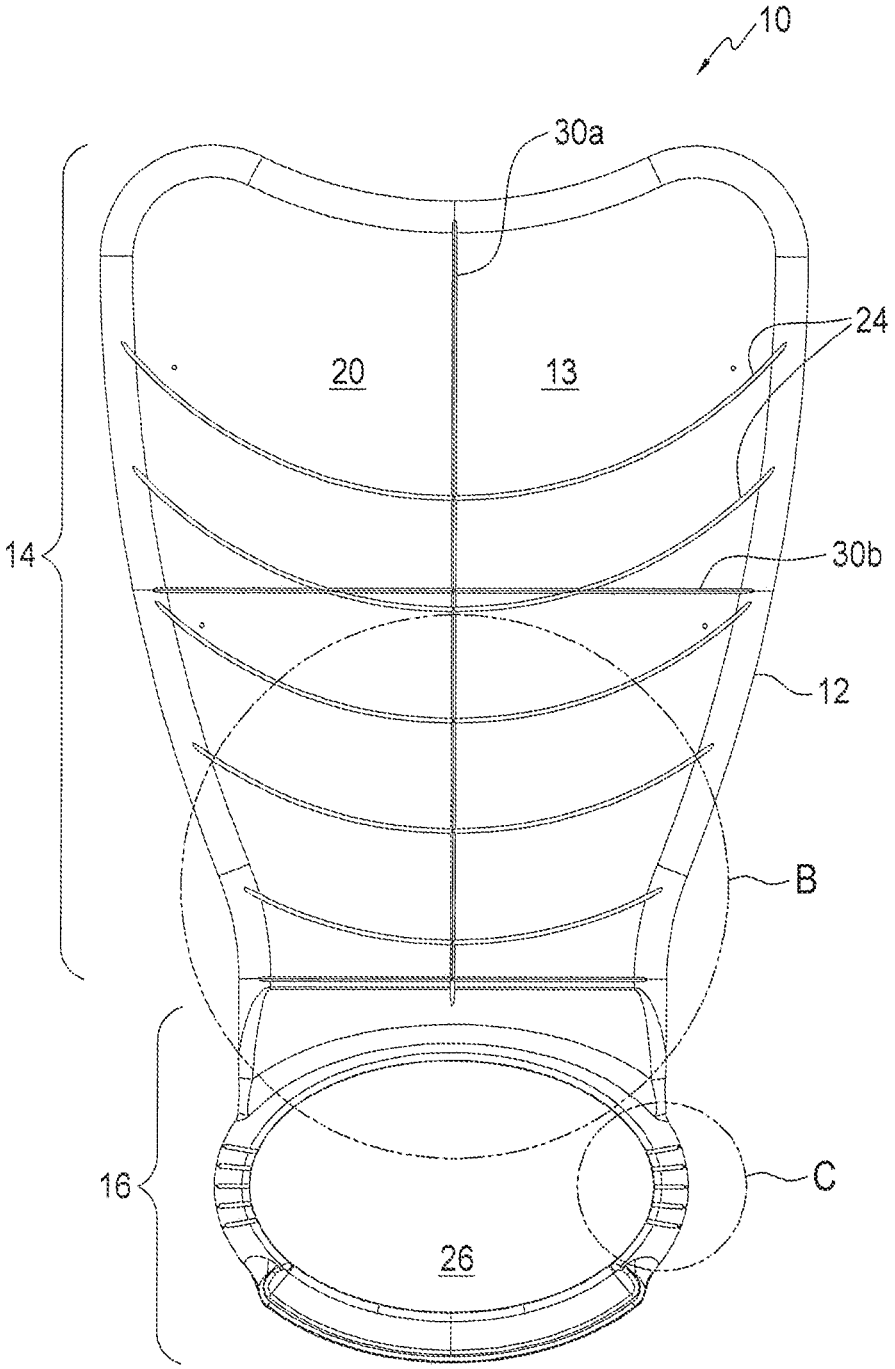
FIG. 6A is a top view of a golf practice mat without accessories.
Figure 6C:
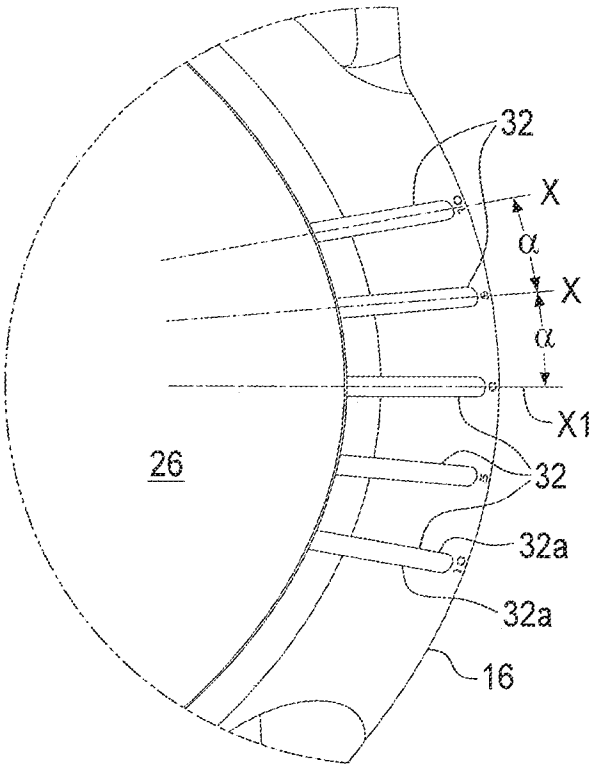
FIG. 6C is an enlarged view of area "C" in FIG. 6A.
Figure 6B:
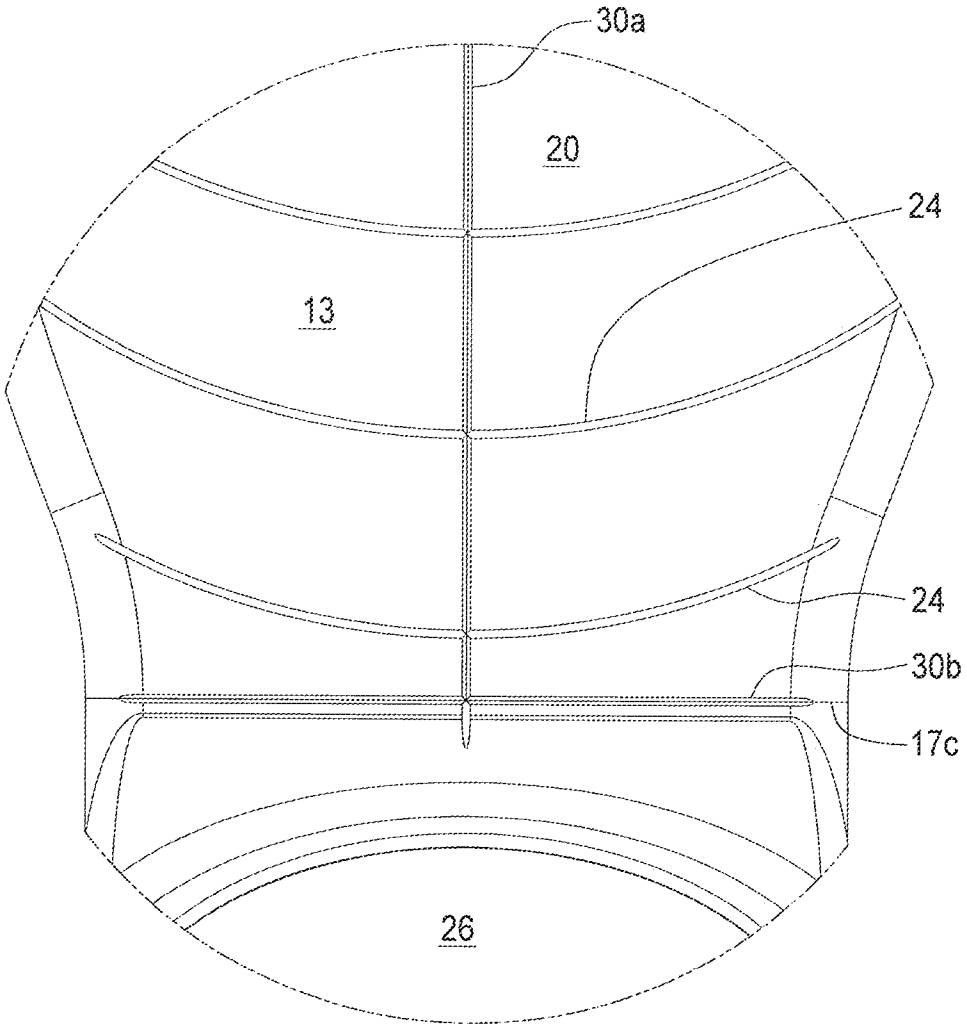
FIG. 6B is an enlarged view of area "B" in FIG. 6A.
Figure 7:
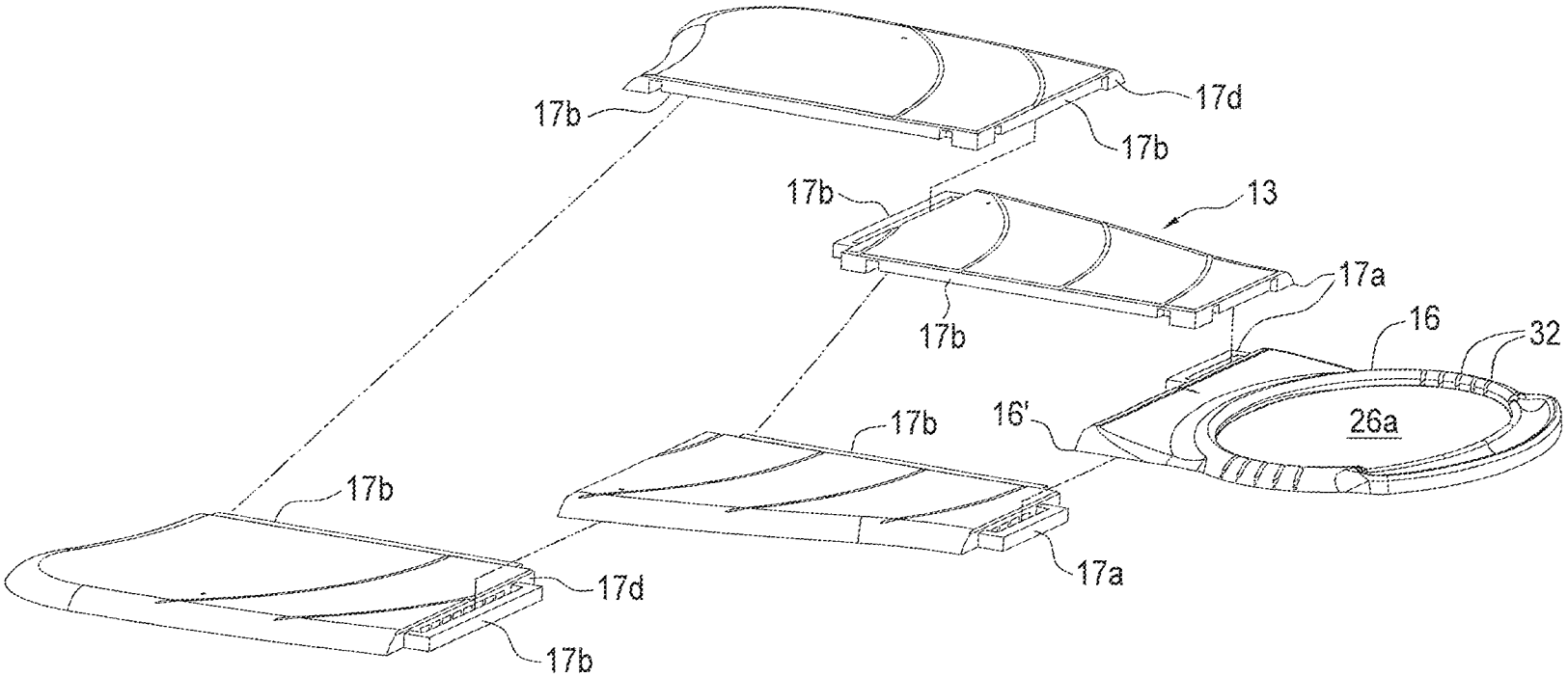
FIG. 7 is an exploded view of a golf practice mat base, showing possible interconnectable components thereof, according to one embodiment of the present invention.

In a sample embodiment, as illustrated in FIGS. 1, 4, and 5, a pair of rods 28 are fitted into holes 34 on each lengthwise side of the stance section 14. Each pair of holes 34 on each side is spaced apart by a distance D that is sufficient to allow a golfer to swing a club while avoiding contact with rods 28 secured in the holes. Having a pair of rods on both sides of the stance section may assist a golfer in aligning his golf swing relative to the strike section. Alternately or in addition, holes 34 may be spaced widthwise (in the same direction as dimension W) across the stance section 14 a distance that normally accommodates a golfers stance (i.e. feet placement), but which if contacted by the hips or legs signals an undesirable side to side sway by the golfer. If the golfer sways during a swing, this is signalled to the golfer by contact of their legs and hips against the rods.

Figure 2:
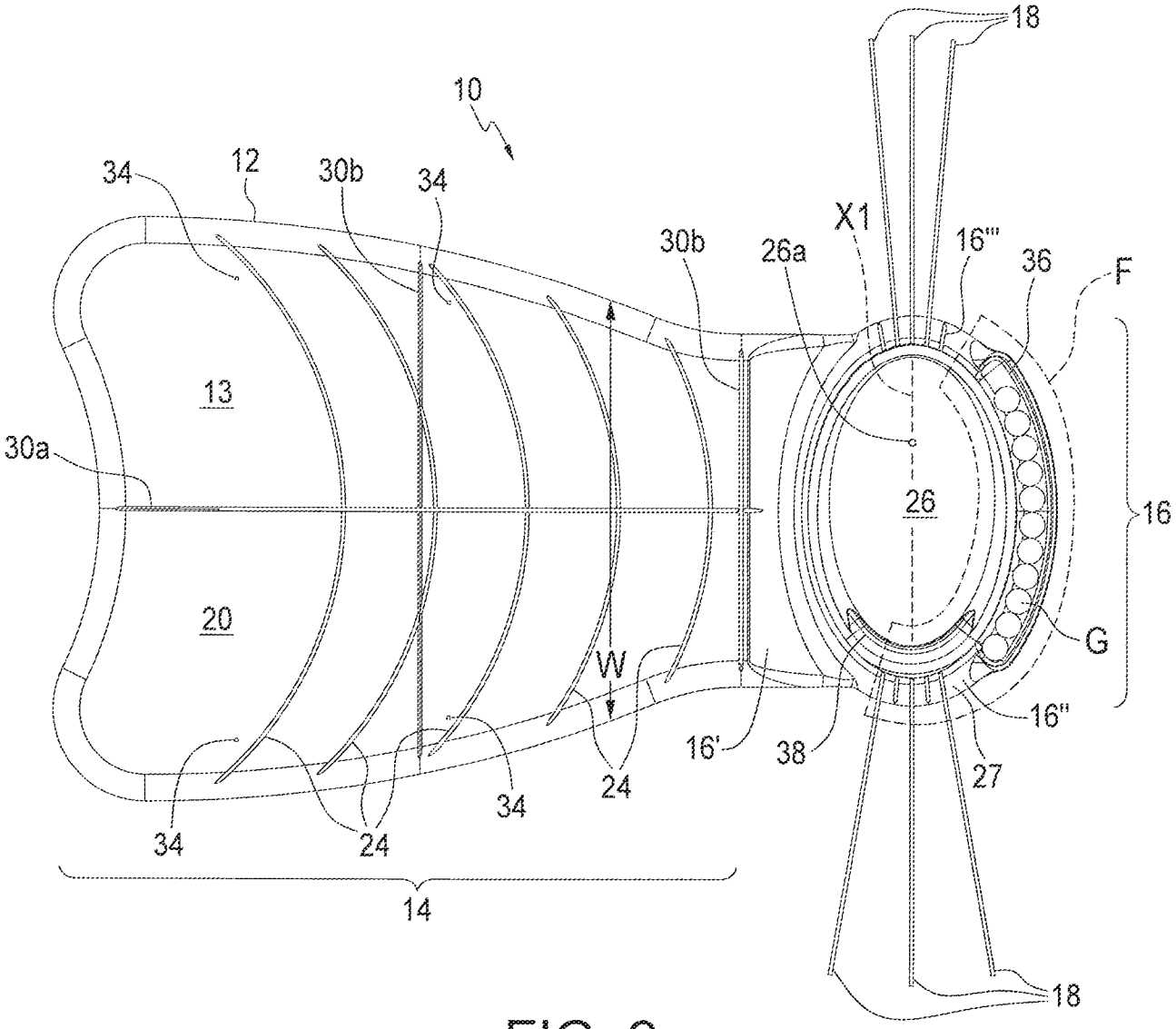
FIG. 2 is a top view of the golf practice mat of FIG. 1.
Figure 3:
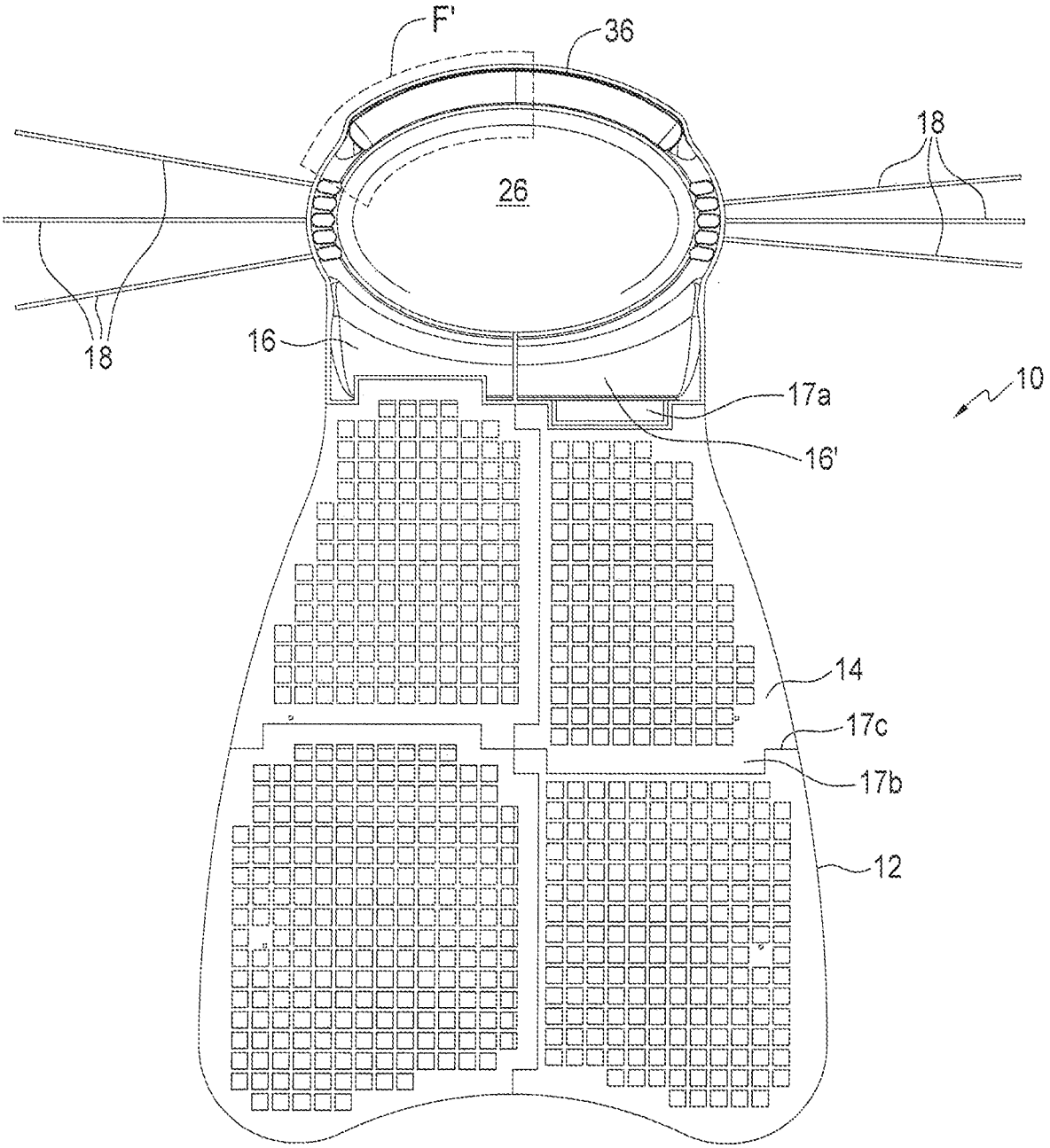
FIG. 3 is a bottom view of the golf practice mat of FIG. 1.

The strike section 16 is positioned adjacent the stance section. Strike section 16 includes a close side 16' that is attachable to stance section 14, a far side opposite the close side and front and back sides spanning between the close side and the far side. For reference, releasable connectors 17*a* are positioned on the close side 16' through which strike section 16 is connected to the stance section. The designation of the front side versus the back side relative to close side 16' may alternate between mats intended for use by golfers with right handed or left handed swings. In the embodiment of FIG. 4, the mat strike section has the same construction on both the back side and the front side. However, as can be seen in the illustrated embodiment of FIG. 2, a strike section can have a back side 16" that differs in some respects from the front side 16". The mat of FIG. 2 is configured for use by a golfer with a right-handed swing, where the club is to be swung in a path from the right to the left.

Strike section 16 further includes a strike surface 26 positioned substantially centrally relative to the sides. Strike surface 26 is the surface on which a ball is intended to be placed for hitting off the mat. Strike surface 26 may be a part of the base or may, as shown, be an insert placed on a receiving area 26*a* of the base.

Strike surface 26 may include a shock absorbing surface such as of foam construction or fibers. While other constructions may be used, strike surface 26, in one embodiment, includes an upper surface formed of an artificial turf material including fibers in cut strands and/or loops extending from a backing material that acts as a more structurally secure portion to retain the fibers. Fiber lengths may vary, as desired. The fibers of the upper surface may be formed of various materials including example, plastics.

In a further embodiment, strike surface 26 includes a hole 26*b* for receiving a golf tee. The strike surface is constructed and sized to support and accommodate a golf ball thereon and to withstand repeated club strikes. It can be appreciated that a ball may not be positioned in the strike surface at all times when the mat is in use. Some useful sizes may be those sized to accommodate a ball and a ball-contacting, bottom portion of a golf swing.

In the illustrated embodiment, the shape of the strike surface is substantially elliptical (also called oval), but of course the strike surface may be of other shapes, including for example a rectangle or other polygon, a circle, etc. In one embodiment, strike surface 26 has a circular or oval shape in plan view, rather than a square or rectangular shape. While strike surface 26 may be shaped other than in the form of a circle or oval, formation of the surface as generally oval, rather than rectangular (i.e. elimination of the corners), offers a reduction in weight and material cost and may be useful as a swing aid, as described below.

In the illustrated embodiment, the strike section includes one or more slots 32 on one or both of the front and back sides. There may be a plurality of slots 32 spaced along each of the front side and the back side of the strike section 26.

Of course, the strike section may include more or fewer slots 32 than the number shown in the illustrated embodiment.

Slots 32 extend substantially radially relative to the planar configuration of the strike section, for example each slot extends such that its long axis X is directed from the outer edge of the strike section toward the strike surface, for example toward a central point of the strike surface. Due to their radial orientation, the long axes x of adjacent slots on each side are each angled a relative to one another. For example, each slot's long axis may be offset from the other slots for example, diverging 3-10°, for example about 5°, relative to that of an adjacent slot. There may be a strike surface main slot, designed as 0 in FIG. 6C, that has an axis X aligned with front to back axis X1 of strike section, which is a straight line between the front side and the back side. There may be one or more slots on one or both sides of the middle slot that are angled relative to the middle slot. The tee hole 26*b* may be aligned with the middle slot and on the straight line between front and back. The slots may be formed to intersect with a central point on the strike surface 26 or with the tee hole 26*b*.

In one embodiment, each slot 32 is configured to removably receive one end of a swing alignment rod 18. Swing alignment rod 18 is the same or similar structure as a stance alignment rod and is preferably a substantially linear structural member having some rigidity and of a regular, known diameter. Preferably, slots 32 are each sized to accommodate the diameter of an alignment rod 18 to hold the rod either loosely, by gravity or more firmly, by snapping in. In one embodiment, each slot 32 has a narrow side to side distance formed by upper edges 32*a* and possibly side walls. The upper edges 32*a* or the entire slot may be formed from or into a resilient material, such as a rubber material or polymer, such that the slot can be narrower than a rod and upper edges or the entire sides may resiliently deform to receive and engage a rod pushed therein. The slot upper edges or sides may be selected to engage a rod, as by frictional engagement, such as a press fit, snap-type engagement. Generally, rods have a diameter of ¼ to ½ inch, for example sometimes about 5/16 inch, and the slot side to side distance is about ⅛ to ½ inch and slightly less than the diameter of the rod to be used.

When one end is received in slot 32, rod 18 serves as an extension of slot 32 (FIG. 1), such that the rod thereby illustrates the angle of the long axis x of the slot 32 in which the rod is received. In other words, if a first rod 18 is received in a first slot and a second rod 18 is received in a second slot adjacent to the first slot, the angle between the first and second rods is the substantially the same as the angle between the long axes of the first and second slots. Placing one or more rods 18 in the slots may assist a golfer standing alongside the close side, for example, on the stance section to visualize a particular shot angle extending from the strike section, along which the golfer may wish to move the club head or strike or launch a ball.

Preferably, there are slots 32 on both the front side of the strike section and the back side of the strike section such that rods can be secured on both sides to guide the down swing as well as the follow through and to accommodate use by both left-handed and right-handed golfers.

The portion of base 12 forming strike section 16 may support strike surface 26 and may form a frame 27 about the strike surface. Frame 27 may have slots 32 formed therein.

Frame 27 may serve other purposes as well. For example, frame 27 may have an indentation 36 formed thereon for holding one or more golf balls G. Indentation 36 may extend along the far side of the strike surface, closely positioned to and partially surrounding strike surface 26.

Where base includes a receiving area 26*a* for strike surface 26, frame 27 may be raised to cause the receiving area to be recessed. The recessed shaping tends to hold strike surface 26 against being dislodged.

Frame 27 may be raised relative to the base of receiving area 26*a* to effectively configure the receiving area as a recessed mounting area for strike surface 26. Frame 27 thereby protects the edge of the strike surface and prevents a golf club from catching and damaging the base of the strike surface, including backing material and the base of the fibers. Frame 27 may include an outer facing surface exposed on the side facing away from strike surface 26. The outer facing surface may be ramped upwardly leading to strike surface 26 such that a golf club hitting the frame is deflected upwardly during the forward motion of the downswing rather than stopped abruptly.

The combination of frame 27 with the oval shape of the strike surface 26, may also provide a golf training feature to deter "casting" or an "outside to in" swing path (i.e. the swing path through impact that leads to ball flight known as a slice). In particular, frame 27, being curved between the back side and the far side of strike section and closely surrounding strike surface 26 creates a surface against which a club will strike, if the swing path is outside to in. Frame 27 may be formed of durable materials such as hard rubber or plastic and will generate a feedback signal to the golfer that they have made an outside to in-type swing. The feedback signal generated may include an interruption, such as deflection, in the swing and at least a vibration in the club or an audible banging noise. This trains the golfer to swing the club more from the inside.

To facilitate features of strike surface protection and training provided by the frame, a further raised lip 38 may be formed on the frame. Lip 38 may have a height raised even above the normal surface of frame, closer to the height of strike surface 26 and may partially or fully extend about the strike surface. In the illustrated embodiment, lip 38 extends only about the back side 16" of the strike section, as this is the area where clubs will tend to impact the base of the strike surface 26.

Figure 8B:
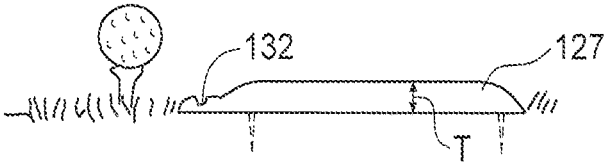
FIG. 8B is a side view FIG. 8A.

The strike section and the stance section may be used separately or together. Also, certain devices may be useful in isolation. In one embodiment such as that shown in FIGS. 8A and 8B, a modified form of strike section 116 including all or a portion of the curved frame 127 but having an empty space S within the frame (i.e. a space instead of strike surface 26 or receiving area 26*a*) may be employed directly on a ground surface with the ground surface exposed for placement of ball B in the empty space (i.e. instead of on the strike surface 26). In such a strike section 116, the curved (i.e. circular or oval) shape between its back side 116" and its far side with or without slots 132 similar to slots 32 and a ball tray similar the ball tray 36 are useful as a golf aid, serving the same purposes as described above with respect to deterring casting and if slots 132 are included, club swing path alignment. If slots are included, the slots are formed on backside 116" and the thickness of the backside may be reduced relative to the thickness T of the far side and the corner between the far side and back side, so that a club can be passed thereover the area of slot 132. Frame 127 may be formed such as that portion indicated as F in FIG. 2 or F' in FIG. 3, with the area of strike surface 26 left empty. For training purposes with respect to correcting a casting error in the swing, the frame need only be that substantially quarter portion extending between the backside intersection of the front to back axis X1 and the far side intersection of the close side to far side axis, as shown by portion F' in FIG. 3.

The frame 127 has an upwardly projecting rounded upper surface of about ¼ to 2 inches for example about ½ to 1½ inches thick at its thickest point with a ramped outer edge such that a club hitting it is deflected up rather than stopped abruptly. The frame may include a ground engagement structure such as spikes or holes for accepting spikes.

In use, the frame portion 127 may be placed on a ground surface, such as grass. The frame 127 may be positioned on the golfer's downswing side, just beyond the golfer's normal swing path and with the concave side of the frame facing the golfer. A golf ball may be placed within the concavely curved area, where strike surface 26 is located in the complete mat. The ball may then be hit from the ground surface. If the golfer makes an outside to in-type swing, the club will hit the frame and a feedback signal will be generated such as an interruption of the swing and at least a vibration or an audible banging noise. This trains the golfer to swing the club more from the inside.

Returning to the mat of FIGS. 1 to 7, in a preferred embodiment, the base 12 of mat, including upper surface 13 and frame 27, is formed of molded plastic or an elastomeric substance such as hard rubber. In one embodiment, at least a portion of the mat, for example upper surface 13, is thermally formable such that it can be deformed by melting and, when allowed to reset after melting and deformation, durably retains the deformed shape. The thermally formable material allows the upper surface of the base to be heated to its melting point and shaped by applying pressure to the upper surface. The shape achieved by melting and deformation by application of pressure remains when the temperature of the upper surface falls below the melting point.

In order to thermally deform the material of the upper surface, the material is heated to a temperature above its forming temperature, which is often considered its melting temperature. The melting temperatures for thermoformable materials are often well know material characteristics and can, in any event, be readily determined for example by simple testing or contacting the material manufacturer. A temperature may be used wherein the material of the upper surface retains its original form until it has pressure applied thereto. At such a temperature, the material may become highly viscous but formable.

In order to reach these temperatures, the sheet material can be placed in an atmosphere with an elevated temperature such that the deformable material can increase substantially to the selected melting temperature. For example, the sheet material can be placed in a heating oven at a temperature to bring the material to its forming temperature and a die can be pressed thereagainst. Alternately, or in addition, the die can be heated, as by heating it directly or driving the die to convey and emit therefrom thermal energy, before being placed into contact with the upper surface of the mat. In so doing, the upper surface of the mat is heat deformed in a shape which is the reverse of the die's outer surface shape, both with respect to the surface relief and perimeter shape, of the die surface. Of course, the rear surface of the sheet material may be supported to hold the sheet material against the pressure of the die.

Thereafter, the heat can be removed to allow the thermally deformed area to cool and thereby set. The heat can be removed by cooling the sheet material (i.e. removing the sheet material from the heated atmosphere), by allowing the die to cool or by removing the hot die from the upper surface. Time is then permitted for the melted mat material to cool and set in its deformed shape. Such a process can be employed to form markings 24, 30*a*, and 30*b* or to apply logos.

The mat may be particularly useful for home training, as its releasably connectable parts, light weight and minimized size make it easy to ship and store. As such, the mat may be sold as a kit including a strike section with a releasable connection 17*a* at its close end 16' and a plurality of releasably connectable stance section components each with at least one releasable connection 17*a*, 17*b* configured to connect to releasable connection 17*a* of the strike section or another releasable connection 17*b* on another stance section component, the strike section and the stance section components all being disassembled. The kit may include instructions for assembly of the strike section and the stance section components to form a complete mat.

The kit can include the strike section and the stance section components stacked one upon the other and packaged within a container, such as a box, that is smaller in length and width than the overall dimensions of the assembled mat. The container can, for example, have a length and width about the size of the strike section, which is much smaller (about ¼ the size of the fully assembled stance section formed by the stance section components).

The mat can be according to any one of the embodiments, as described above. For example, if any of the strike section or the stance section components include swing training features such as any of markings 24, 30*a* or 30*b*, holes 34, frame 27, slots 32 or lip 27, the instructions can include a description of the one or more swing training features and their use for golf practise.

The kit may also or alternately include a strike surface for the strike section, where the strike surface is formed as an insert installable in a receiving area on the strike section. The strike surface may be formed of artificial turf. The kit may provide instructions on the installation of the strike surface into the receiving area.

The kit may include a reusable tee for installing in the tee hole 26*a*.

The previous description of the disclosed embodiments is provided to enable any person skilled in the art to make or use the present invention. Various modifications to those embodiments will be readily apparent to those skilled in the art, and the generic principles defined herein may be applied to other embodiments without departing from the spirit or scope of the invention. Thus, the present invention is not intended to be limited to the embodiments shown herein, but is to be accorded the full scope consistent with the claims, wherein reference to an element in the singular, such as by use of the article "a" or "an" is not intended to mean "one and only one" unless specifically so stated, but rather "one or more". All structural and functional equivalents to the elements of the various embodiments described throughout the disclosure that are known or later come to be known to those of ordinary skill in the art are intended to be encompassed by the elements of the claims. Moreover, nothing disclosed herein is intended to be dedicated to the public regardless of whether such disclosure is explicitly recited in the claims. No claim element is to be construed under the provisions of 35 USC 112, sixth paragraph, unless the element is expressly recited using the phrase "means for" or "step for".

We claim:

1. A golf practice mat comprising:

a strike section including:

a frame including a close side, a far side opposite the close side, a front side and a back side, the front side and the back side each spaced apart and spanning between the close side and the far side, the frame being curved between the back side and the far side and the frame having an oval shape in plan view and being formed of a hard material, a receiving area in the frame, the receiving area is recessed in the frame and the frame includes an outer facing surface exposed opposite the receiving area and the outer facing surface is ramped upwardly leading to a normal height surrounding the receiving area and a lip on the frame positioned only along the back side, the lip having a height raised above the normal height, and a shock absorbing surface in the receiving area; and a stance section including:

a first length wise side, a second length wise side, a first end spanning the first lengthwise side and the second lengthwise side, a rear end opposite to the first end, and a first releasable connection at the first end where the stance section is releasably connectable to the close side of the strike section;

the stance section having a perimeter shape (i) that defines two rear end corners at the rear end and a concave curvature between the two rear end corners and (ii) that is trapezoid-like with a width between the first lengthwise side and the second lengthwise side that tapers from the rear end to the first end, and includes a base with an underside for placement on a ground surface and an upper surface, the base being segmented into a plurality of stance section components, at least one of the plurality of stance section components including (a) at least a portion of the first releasable connection and each of the plurality of stance section components including (b) a second releasable connection configured to releasably connect to the second releasable connection of another one of the stance section components, the plurality of stance section components each including an interconnecting edge at the second releasable connection, the interconnecting edge being exposed on the upper surface and, when a first stance section component is connected with another stance section component, the interconnecting edges define therebetween a seam that is aligned along a line from the first end to the rear end, creating a center, length-wise straight stance alignment line on the upper surface; and the stance section further comprising a first arc shaped marking on the upper surface of the stance section extending across the width and a second arc shaped marking on the upper surface of the stance section extending across the width and spaced from the first arc shaped marking.

* * * * *